US006527139B2

(12) United States Patent
Seagle

(10) Patent No.: US 6,527,139 B2
(45) **Date of Patent: *Mar. 4, 2003**

(54) SECURE DISPENSING MAGAZINE FOR AN ARTICLE DISPENSER

(75) Inventor: Donald Lee Seagle, Sandy Valley, NV (US)

(73) Assignee: Asahi Seiko Co., Ltd., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 09/853,283

(22) Filed: May 11, 2001

(65) Prior Publication Data

US 2001/0050288 A1 Dec. 13, 2001

(30) Foreign Application Priority Data

May 12, 2000 (JP) ..... 2000-140275

(51) Int. Cl.[7] ..... A47F 1/04
(52) U.S. Cl. ..... 221/154
(58) Field of Search ..... 221/197, 154, 221/198, 232, 253, 259, 282, 268, 231

(56) References Cited

U.S. PATENT DOCUMENTS 5,647,507 A * 7/1997 Kasper ..... 221/151
6,050,448 A 4/2000 Willis
6,196,416 B1 3/2001 Seagle

FOREIGN PATENT DOCUMENTS

EP 805772 11/1997
EP 1071052 1/2001

* cited by examiner

*Primary Examiner*—Christopher P. Ellis
*Assistant Examiner*—Richard Ridley

(57) ABSTRACT

A secure dispensing magazine for an article dispenser capable of dispensing a plurality of stacked articles includes a housing member having a lid that is operable to permit access to an internal cavity. The lid can be secured to the housing member and an internal gate member can be movable mounted within the housing member to permit the dispensing of articles. A gate operating mechanism can permit the gate to be opened and the magazine to be secured to a dispensing apparatus, while a gate locking assembly can lock the gate member after it has cycled through an open and closed position.

12 Claims, 8 Drawing Sheets

SECURE DISPENSING MAGAZINE FOR AN ARTICLE DISPENSER

BACKGROUND OF THE INVENTION

1. Field of the Invention

The present invention relates to a dispensing apparatus that can be recharged with articles such as magnetic cards for telephone usage, IC cards, cash value script, value credit cards, and the like. More particularly, the present invention relates to a lockable cassette, or magazine, in which the inventory of articles being dispensed can be securely provided to a vending machine.

2. Description of the Prior Art

Vending machines for dispensing various articles, such as prepaid telephone cards, has been known in the art. Various forms of compact equipment for dispensing such cards have been known such as disclosed in U.S. Pat. No. 4,993,587 and European Laid Open Patent Application Ser. No. EP 0 805 772. An example of prior art can be seen in FIG. 8 wherein a cube shaped storage member can support a vertically aligned stack of laminated card bodies 3. A support plate 4 supports the stacked array of cards 3 and is apertured with a window 38 to permit a friction roller 5 to extend into the storage space for sending out a card. Adjacent the aperture window 38 is a small apertured window 39 that permits an arm 44 of a micro switch to contact the stack of cards and to indicate when the storage space is empty.

An exit aperture 40 permits a delivering roller 7 to dispense the lowest card in the stack of cards. Adjacent to the delivering roller 7 is an inversion roller 8 which is rotated in a reverse direction to the card delivering direction to thereby ensure that only one card is sent out at a time. It is also possible to reverse the movement of the roller 5 if there has been a jam in order to clear any cards that are stuck.

A problem in the use of such a card dispensing structure has been the susceptibility of having valuable cards misappropriated or stolen by service personnel.

SUMMARY OF THE INVENTION

The present invention provides a secure magazine for holding a plurality of articles to be dispensed from a dispensing machine and further provides the combination of a secured magazine and a dispensing apparatus. A housing member with a cavity for storing articles having a pivotal lid provides the structure of the magazine. The magazine can be releasably secured to a dispensing apparatus for appropriately dispensing the articles. The magazine can have a lock member for locking the lid to the housing member. A gate member is movably mounted within the housing member to control an exit aperture through which the articles are dispensed. When the magazine is initially charged with articles, the lid member can be secured by a lock member and the gate member is initially set as a closed position. Service personnel can then install the secure magazine in the appropriate dispensing apparatus.

A one cycle gate operating mechanism includes a movable actuator movable from a first position to a second position to permit the securement of the magazine to dispensing apparatus. The movable actuator also is coupled to the gate member for moving the gate member from the initial close position to an open position for dispensing the articles by the dispensing apparatus. The actuator can also be moved back to a first position to release the magazine from the dispensing apparatus and to permit the closing of the gate. A gate locking apparatus will lock the gate member in the closed position after the one cycle of the gate operating mechanism. Accordingly, if the gate mechanism is open to permit the removal of articles, when the gate is again closed, it will prevent the magazine from being operatively mounted to the dispensing apparatus and the personnel in control of the secure magazine will have to explain the failure to properly install the magazine and to explain the missing articles.

BRIEF DESCRIPTION OF THE DRAWINGS

The exact nature of this invention will be readily apparent from consideration of the following detailed description in conjunction with the accompanying drawings, wherein.

DETAILED DESCRIPTION OF THE PREFERRED EMBODIMENTS

The following description is provided to enable any person skilled in the art to make and use the invention and sets forth the best modes contemplated by the inventor of carrying out his invention. Various modifications, however, will remain readily apparent to those skilled in the art, since the general principles of the present invention have been defined herein to specifically provide a security magazine that provides a controlled operation of a gate member to prevent theft.

The content of U.S. Pat. No. 6,196,416 is hereby incorporated by reference to supplement the present disclosure.

The security magazine of the present invention includes a gate operating mechanism that can prevent theft from the magazine. If an individual attempts to remove articles from the loaded magazine, he can open the gate to an open position. However, once the gate operating mechanism has been cycled from a closed to an open position and back to a closed position, the gate may not be opened again and it can not be mounted in a dispensing machine. Thus, a limited cycling of the gate movement is provided. A route operator removing articles from the magazine will find that the magazine can no longer be placed in the dispensing mechanism and therefore would be required to explain the situation. Further, a magazine removed from the dispensing mechanism and still including articles may not again be opened to remove the remainder of the articles.

Figure 1:
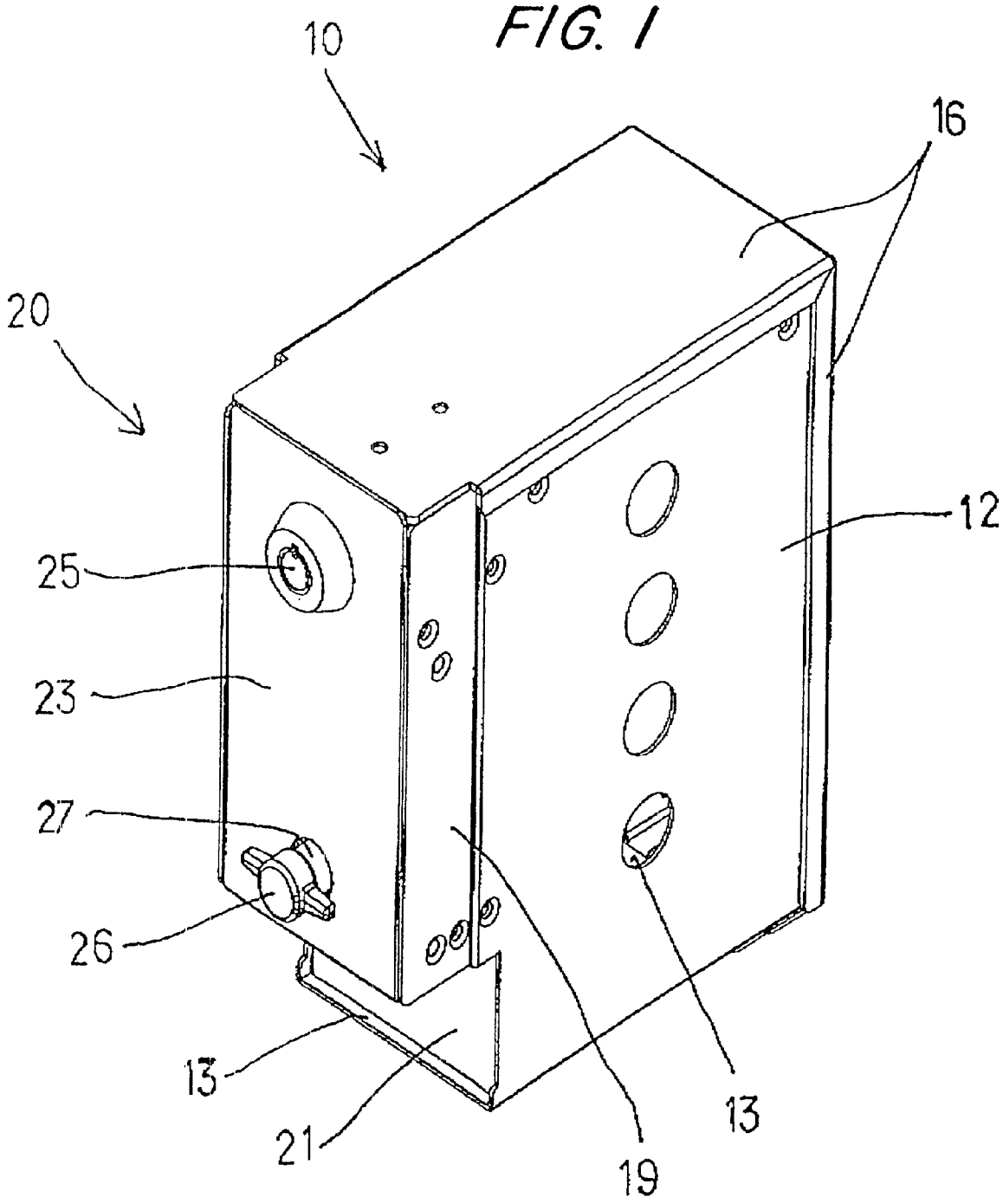
FIG. 1 is a perspective side view of a dispensing magazine with security features.
Figure 2:
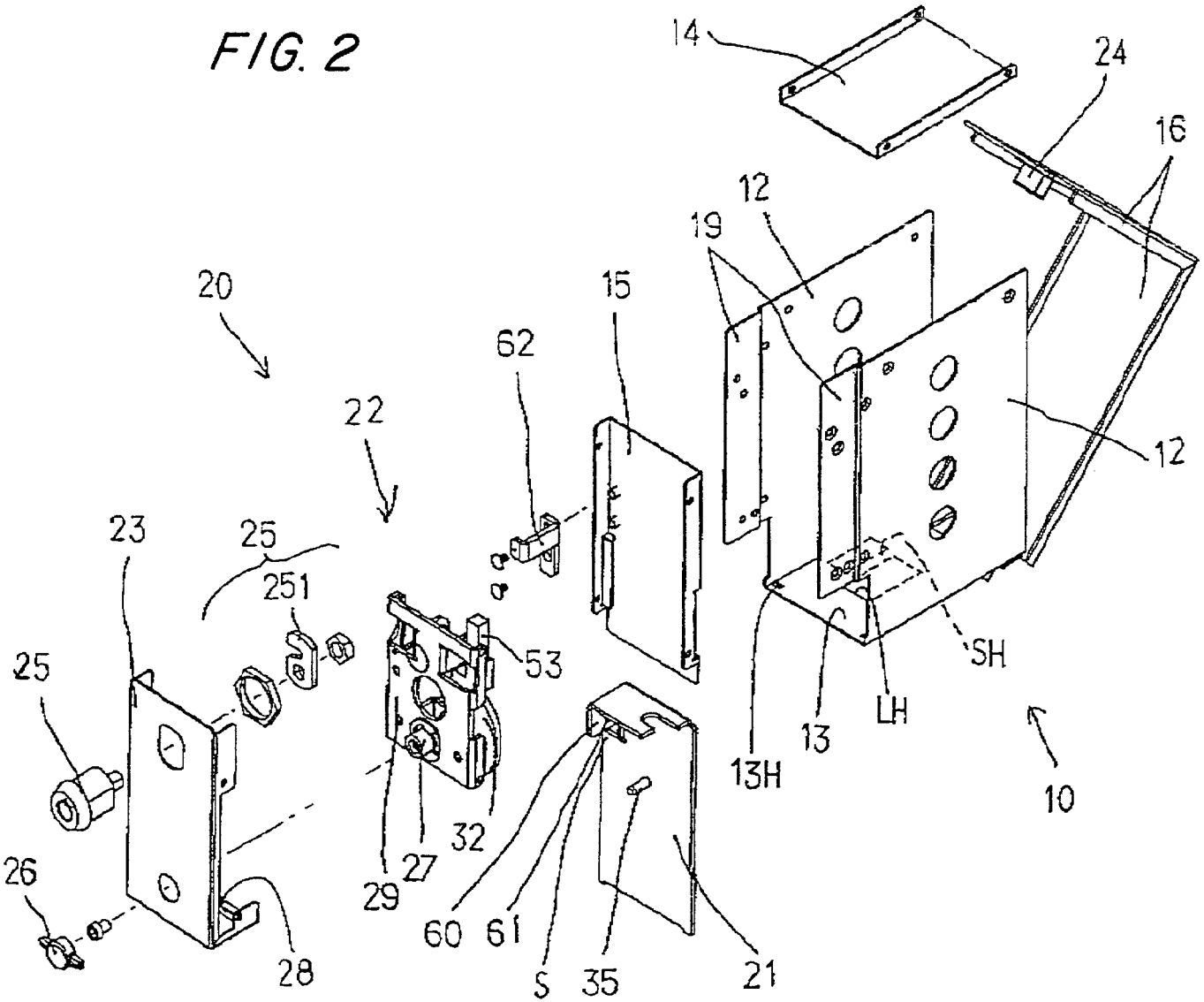
FIG. 2 is an exploded view of the components of the magazine of FIG. 1.

Referring to FIG. 1, the security magazine or cassette 10 of the present invention for holding a stacked array of articles to be dispensed includes a rectangular base plate 13 and side rectangular members 12 which extend upward from the base plate 13, respectively. A top plate 14, as shown in FIG. 2, connects the respective side board members 12. A front plate 15 extends partially across the front dispensing end of the cassette while leaving an opening at the bottom thereof. As can be seen from FIG. 2, the rear portion of the cassette magazine 10 can be opened and an L shaped lid plate 16 is pivotally mounted about a hinge member 17 at the rear of the magazine 10 and can extend forward and over not only the side boards 12 but also the flanges or protuberances 19 extending forward from the front of the side board members 12 to complete the housing structure of the magazine 10 with an internal storage cavity. When the lid plate 16 is open, the articles to be dispensed can be easily recharged into the cavity of the magazine 10. The front plate 15 is mounted between the side boards 12 and creates with the lid plate 23 a cavity there between for receiving a thin box shaped security mechanism 22 to be subsequently described. Additionally, a rectangular gate member 21 is movably positioned in front of the front plate 15. The gate can be moved, as will be subsequently described, to provide a security function.

Mounted on the upper portion of the lid plate 23 is a lock mechanism 25. The lock mechanism 25 can be activated by a key (not shown) and its function is to provide a secure engagement with the large L shaped lid plate 16 so that it can be locked onto the magazine. As shown in FIG. 2, a hook member 251 that is mounted on the lock mechanism 25 can securely engage and hold a loop or keeper portion 24 mounted on the pivoted L shaped lid plate 16. Thus, supervisory personnel can charge the magazine 10 with the articles to be dispensed and can then lock the lid plate 16 in place. The charged magazine 10 can then be provided to the delivery personnel for installation in a vending machine.

Figure 3:
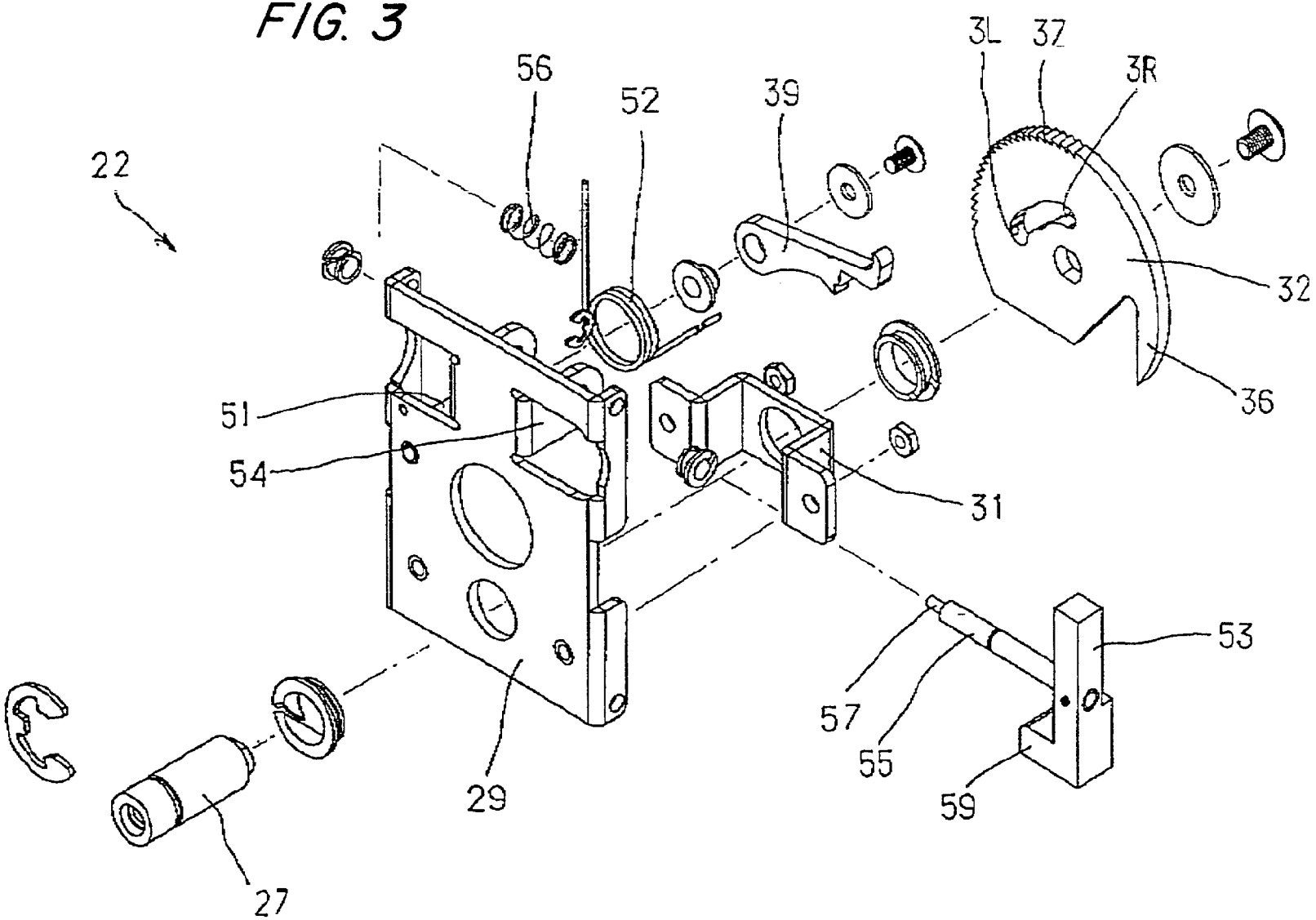
FIG. 3 is an exploded view of a portion of security apparatus for the magazine.

A second locking mechanism is formed on the lower part of the lid plate 23 and has a freely rotatable actuator knob member 26 with lateral wings. The knob 26 is fixed on the outside edge of a tube shaft 27, as can be seen in the exploded view of FIG. 3. The shaft 27 can be secured to the front of a bracket plate 29 through an E-shaped clamp that engages a groove on the shaft 27. The shaft 27 extends through a mounting bracket 31 having a U-shaped configuration with an appropriate aperture. A cam member 32 having a series of ratchet teeth 37 is affixed to the inner edge of the shaft 27 to function as an actuator. The cam member 32 has an arc shaped cam groove formed adjacent to center of the cam member. As can be seen in FIG. 3, this cam groove is formed with a circular configuration 3R at the right side and an arc division 3L at the left side which permits an initial rotation of the cam member 32 without movement of the gate member 21. A pin shaft 35, which is positioned on the gate member 21 (shown in FIG. 2), is joumaled within the cam groove and is mounted to be driven by the movement of the cam groove. At a lower outside circumference of the cam member 32, a hook or keeper member 36, is integrally formed. This hook portion 36 is roughly diametrically opposite the ratchet teeth portion 37. A biased ratchet pawl 39 meshes with the ratchet teeth 37. The ratchet pawl 39 is mounted on the bracket board 29 for free rotation and is installed with an appropriate dimension cylindrical spacer 51 that can also mount a coil spring 52 that can bias the pawl member 39 into engagement with the ratchet teeth 37. A T-shaped lever 53 is positioned at the right side of the bracket board 29 (shown in FIG. 3), and can act as a pin body for the security lock.

Mounted horizontally is a pin shaft 55 at the center portion of the pin body 53 which can extend through apertures in the flange 54 (shown in FIG. 3). Between the pair of flanges 54, a spiral spring 56 is mounted on the pin shaft 55. At the end or tip of the pin shaft 55, a pin 57 of a reduced diameter is formed. The lower portion of the pin body 53 is bent or curved to form the projection 59 for contacting a cam surface of the pawl lever 39.

Referring to FIG. 2, the gate member 21 has a key hole 61 formed in the vertical standing member 60. The pin 57 is freely inserted into a small diameter hole at the lower part of the key hole 61, while the small pin shaft 55 is freely inserted into the large diameter hole at the upper part of the key hole 61. A small L-shaped member 62, shown at the central upper part of FIG. 2, acts as a stopper in the horizontal direction and can be slid freely through the left division of the front plate 15 by screws. A spring 63 can also be arranged between the stopper 62 and the bracket board 29. Therefore, the stopper member 62 would be pulled in a downward direction towards the cam board 32.

Figure 7:
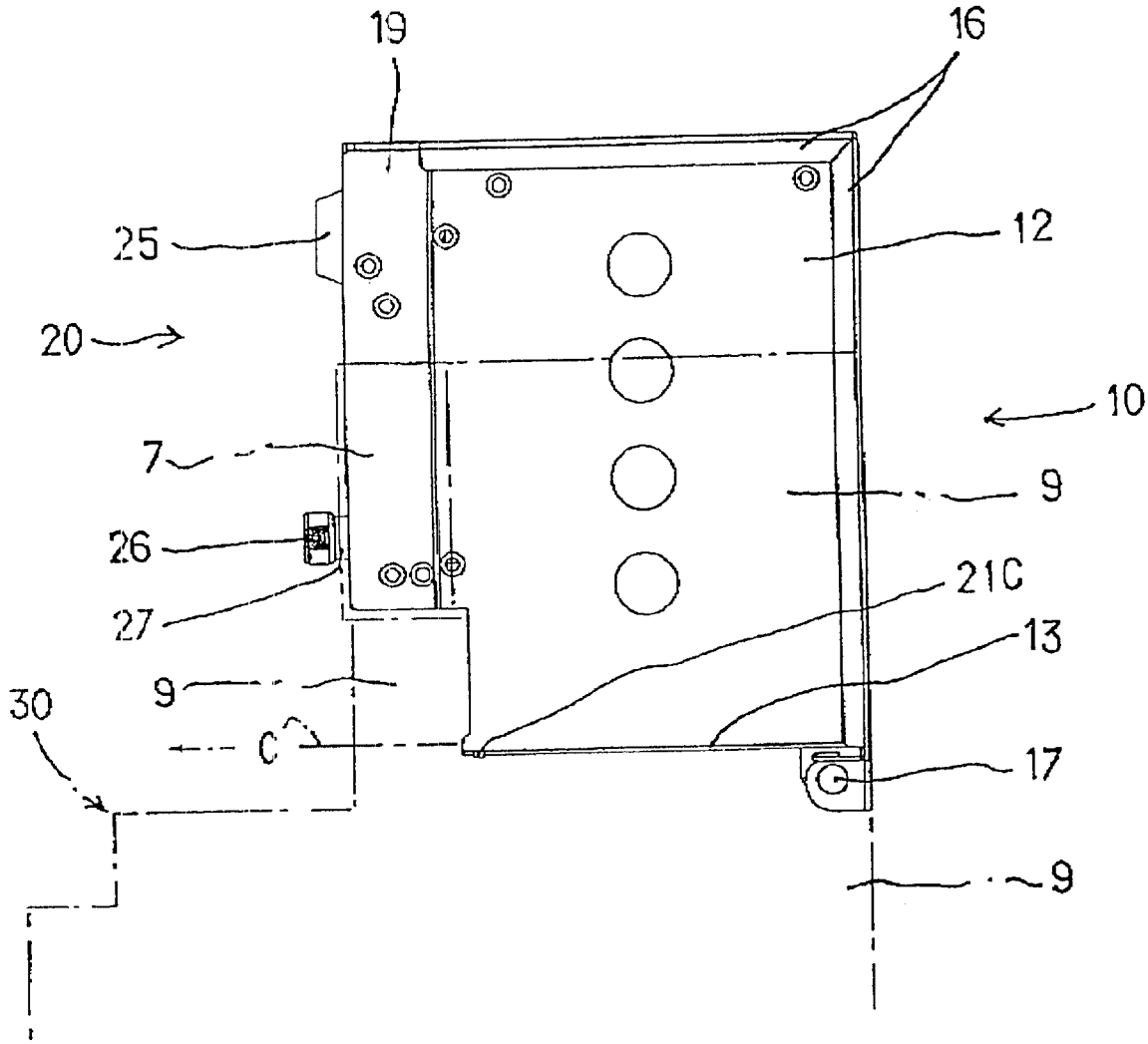
FIG. 7 is a side view of the magazine mounted in a vending machine.

In operation, the management personnel can install a large number of articles to be dispensed within the cavity of the magazine 10. The rotation of the lid plate 16 with the large L-shaped cassette configuration permits ready access for charging the magazine 10 with an array of articles stacked on the base plate 13. The operator can then rotate and level the knob 26 (as shown in FIG. 1) so that the arms of the knob are horizontal. A mounting bracket shown only in phantom lines in FIG. 7 is mounted in the dispensing machine and has a way of a dove shape for receiving the knob 26 to ensure a proper alignment of the magazine. With the gate in an initial lowered position, the knob 26 can be inserted through the way. Through the opening at the top of the cavity 20, the top of a T-type pin body 53 is moved in the right direction by rotation against the spring 56 (shown in FIG. 4*a*). At this time, the smaller diameter pin 57 of the pin body 53 extends into the key hole 61 of the standing member 60. Simultaneously, the stopper 62 drops by the action of the spring 63. As a result, the upper part or large diameter portion of this key hole 61 is closed by the stopper 62. Thus, the small diameter pin 57 and the large diameter portion of the key hole 61 will be stopped by the stopper 62. In the above mentioned condition, by the rotation of the lid plate 16 with the L-configuration, the large opening of the cassette division 10 and the top opening of the equipment division 20 are closed. The operator can then insert a key (not shown) into the primary lock mechanism 25 and the cassette equipment is then locked.

Figure 8:
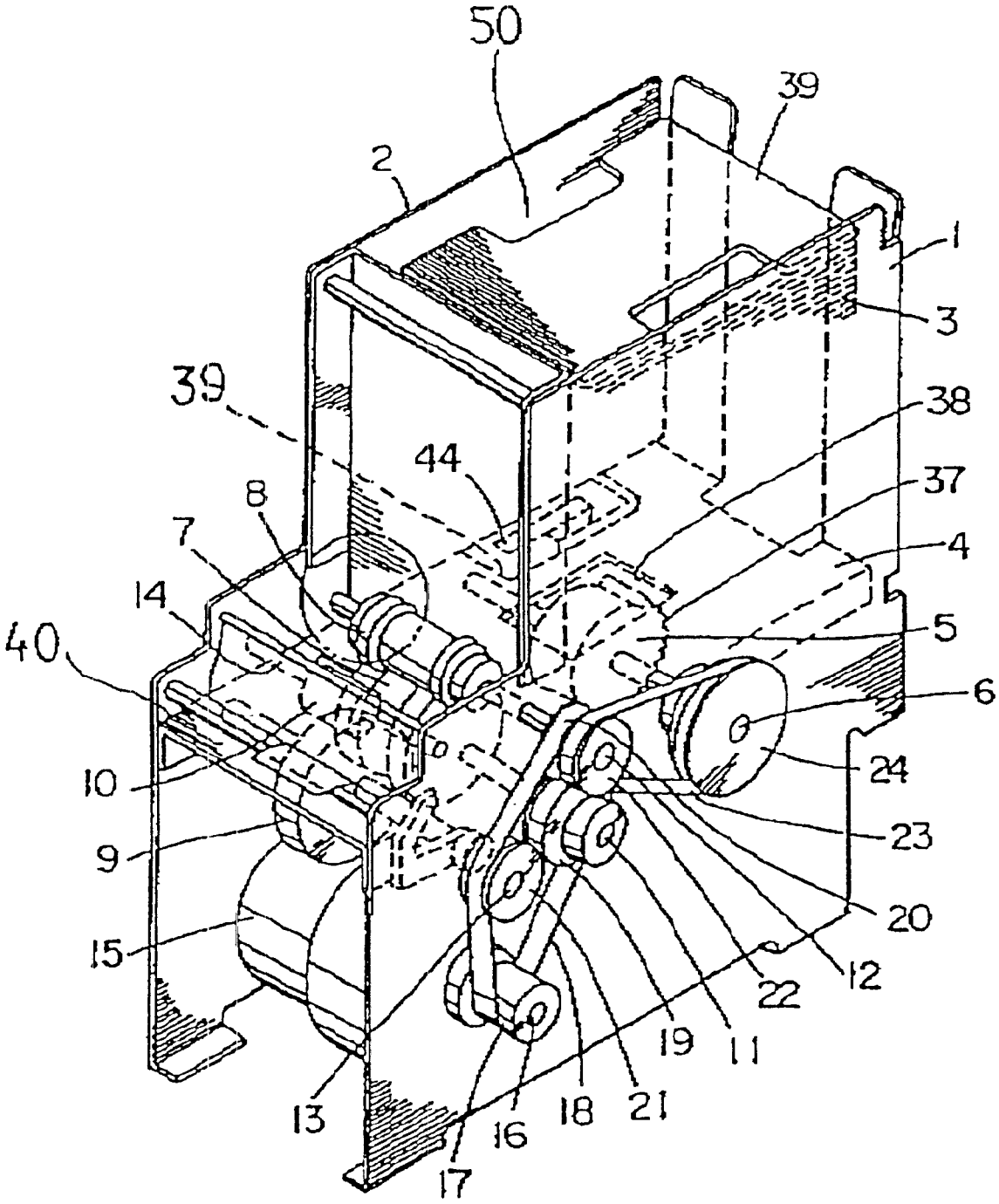
FIG. 8 PRIOR ART
FIG. 8 is a schematic view of a prior art example.

The loaded cassette member can then be provided to the service personnel while the management personnel can keep and store the key. The locked cassette equipment is then installed by the service personnel on an appropriate card dispensing equipment 30 of a vending machine. The front upper part between the right and left side board members 9, which constitute both sides of the disposition equipment 30, is surrounded by the lock board 7 with a U-shape. The cassette member 20 is set between the paired side boards 9 of the disposition equipment 30. The knob 26 is inserted into a lock hole 6 (shown in FIG. 4*a*) with the wings of the knob 26 appropriately aligned. At this time, the large hole LH (shown in FIG. 2) at the center of the base plate 13, communicates with the large window 38. In addition, the small hole SH (also shown in FIG. 2) at the side of the base plate 13 is aligned with the small window 39 in FIG. 8. Knob 26 on the lock member is rotated by 45° in the rightward direction after it has been inserted into the lock hole 6 or way (see FIG. 5*a*). At this point in the operation, the knob 26 cannot be rotated, even if an attempt is made to rotate the knob 26 in the left direction in order to remove the cassette equipment from the dispensing apparatus or equipment 30. The rack pawl 39 engages with the rack teeth 37 to prevent any rotation in the leftward direction.

As mentioned above, the hook portion 36 of the cam board 32 is cut into a slot 28 which is at the base of the L-shaped lid plate 23. Simultaneously, the hook portion 36 will also extend into a slot 5 (refer to FIG. 6) of the lower portion of the lock board 7. The locking knob 26 is further rotated about 45° in the right direction (shown in FIG. 6) so that the direction of the knob 26 is now rotated a full 90° to be perpendicular to its original position shown in FIG. 4A. At this time, the arc division 3L of the cam groove causes the pin shaft 35 to be pushed up and the gate board will also be vertically lifted upward. As a result of this movement of the gate board 21, an exit aperture 3 for the card or article to be dispensed will be formed between the lower edge of the gate board 21 and the base plate 13 (shown in FIG. 6*a*). Additionally, the shoulder S (referring to FIG. 2) near the key hole 61 on the gate board 21 will push up the stopper 62 against the resistance of the spring 63. Thus, the small diameter pin 57 in the key hole 61, which was previously held or stopped by the stopper 62, is now placed into a free condition. Thus, the small diameter pin 57 penetrates into the lower or small diameter portion of the key hole 61 which has been moved. When the small diameter pin 57 is freed, the spring 56 can move the pin body 53 in the left direction (refer to FIG. 6*a*). Accordingly, the projecting division 59 of the pin body 53 will push up the rack lever 39 against the resistance of the spring 52. As a result, the rack lever 39 is moved away from the ratchet teeth 57 and the cam board 32, or knob 26, can be freely rotated. In this condition, the cards that are stored within the cassette magazine 10 can be freely dispensed from the exit aperture 3 in the disposition or dispensing equipment 30.

When the cassette member is to be detached from the dispensing equipment 30, the knob 26 is rotated first about 45° in the leftward direction. Since the knob 26 can be freely rotated, the rack lever 39 will be pushed up by the projecting division 59 on the pin body 53. When the knob 26 begins to rotate in the leftward direction, shoulder S, which was pushing up the stopper 62, comes off. As a result, stopper 62 is freed and contacts the small diameter pin 57 by the action of the spring 63. When the locking knob 26 is further rotated in the left direction, pin shaft 35 is depressed by the arc division 3L of the cam groove (shown in FIG. 5*a*). As a result, the gate board 21 will be moved downward and the exit aperture 3 for the cards will be closed.

Figure 4B:
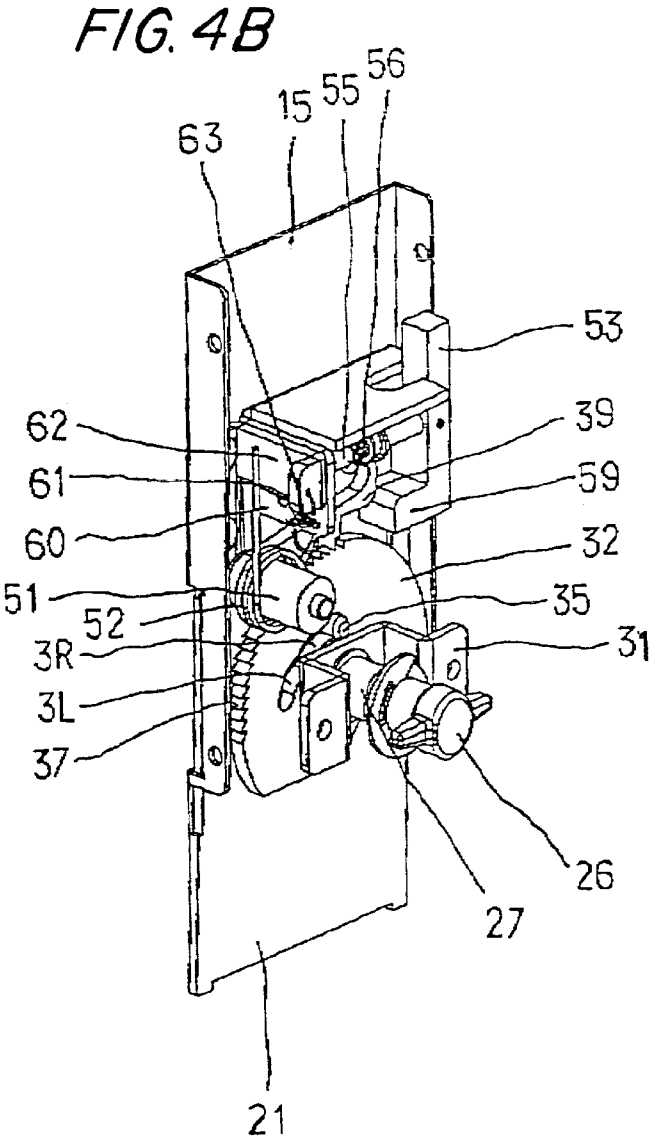
FIG. 4*b* is a perspective view of the security apparatus.
Figure 4A:
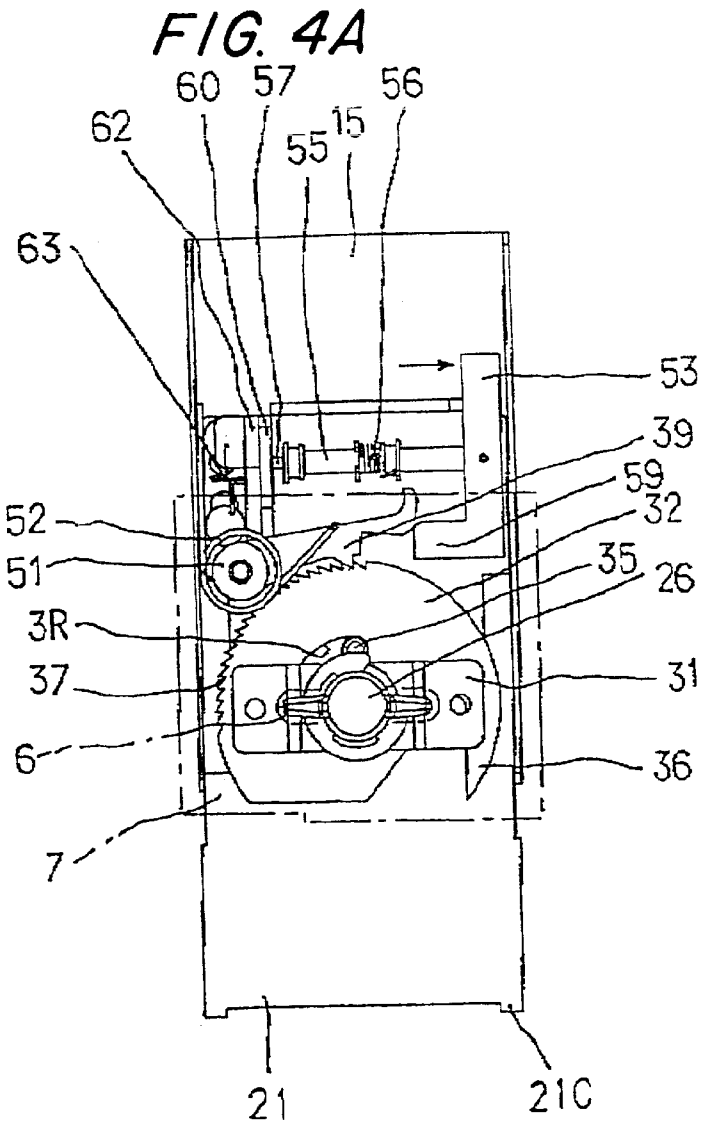
FIG. 4*a* is a rear elevational view of the security apparatus.
Figure 5B:
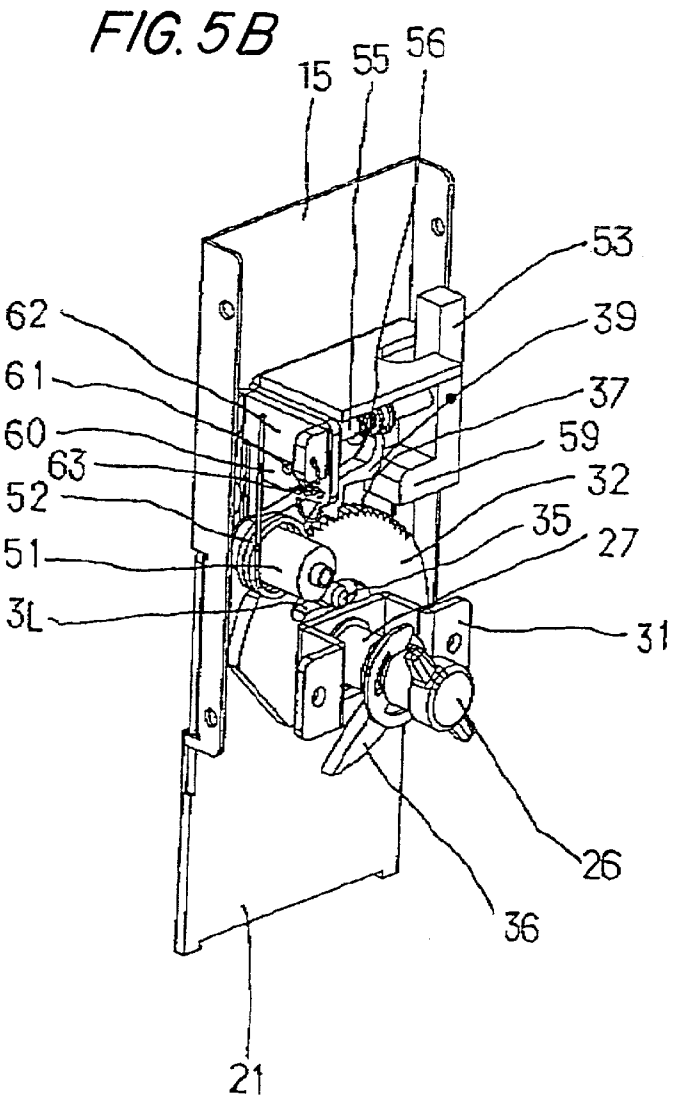
FIG. 5*b* is a perspective view of the security apparatus in operation.
Figure 5A:
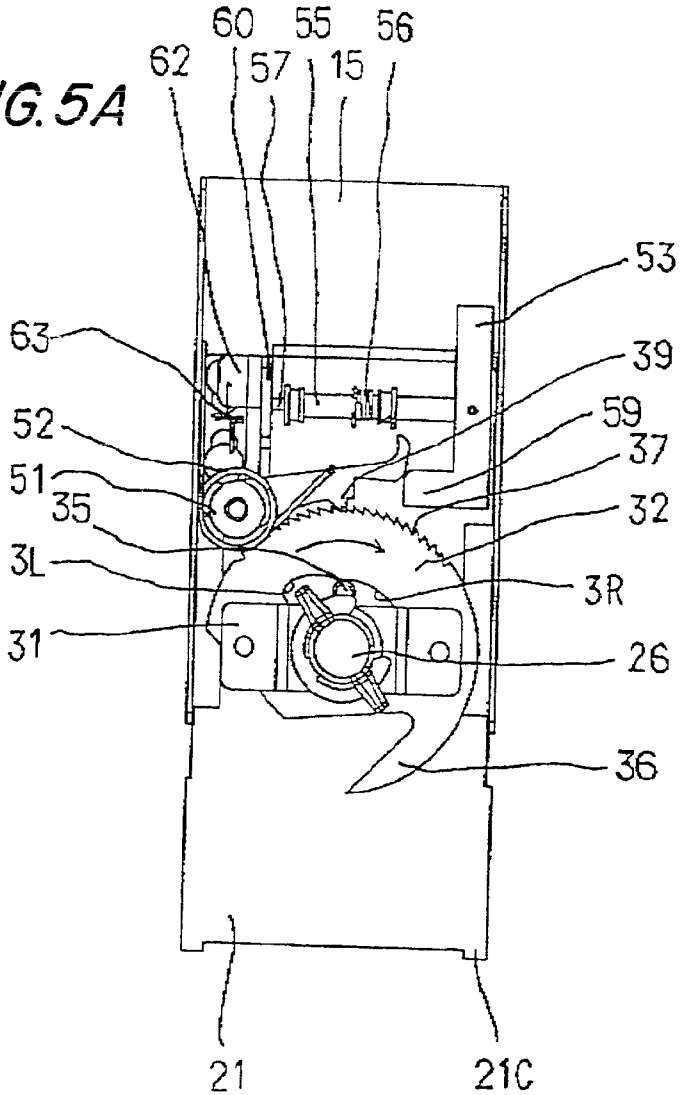
FIG. 5*a* is a rear elevational view of the security apparatus in operation.
Figure 6B:
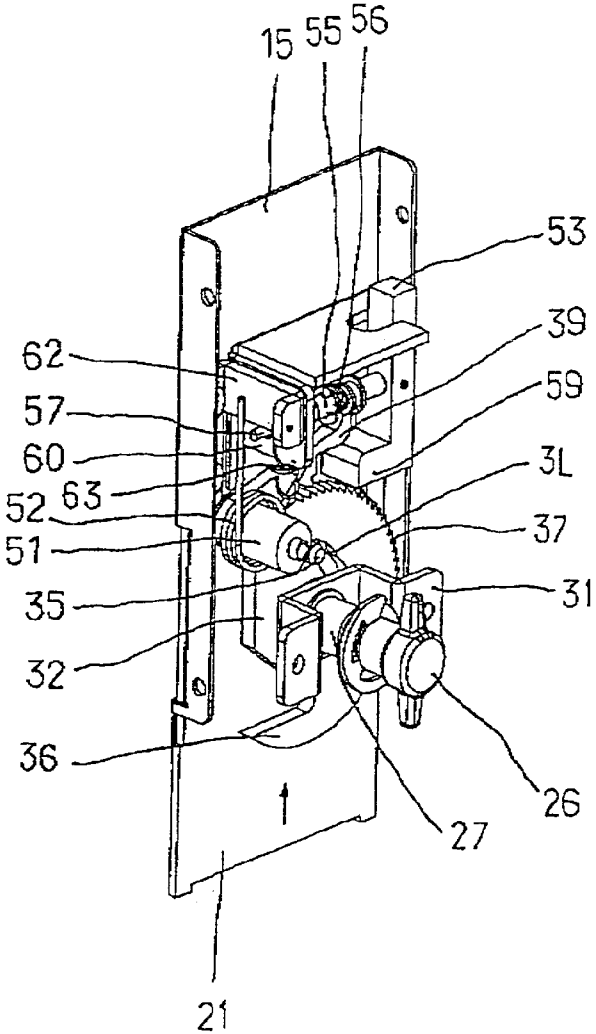
FIG. 6*b* is a perspective view showing the security apparatus in a locked position.
Figure 6A:
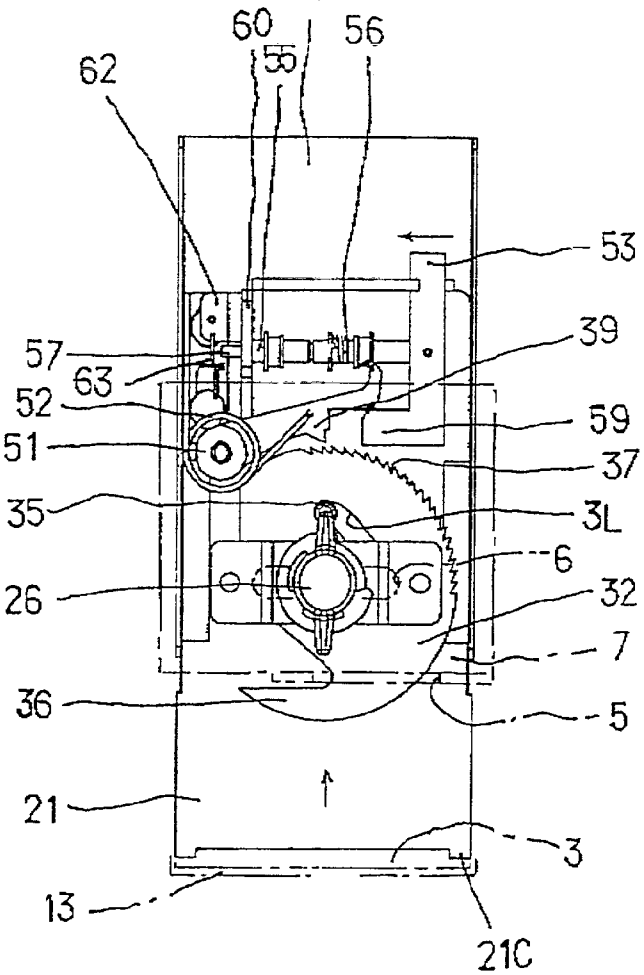
FIG. 6*a* is a rear elevational view showing the security apparatus in a locked position.

Additionally, with the rotation of the knob 26, the large diameter pin shaft 55 will fit into the upper part, or large diameter portion of the key hole 61 of the descending gate board 21. This will ensure that the locking action becomes secure, since the large diameter pin shaft 55 is inserted into the large diameter portion of the key hole 61 by means of the force of the spring 56. As a result, the gate board 21 will be securely locked by means of the key hole 61 and the pin shaft 55. As a result, the aperture part exit 3 of the cassette equipment cannot be opened, even if the knob 26 is attempted to be strongly rotated by the operator. Additionally, the knob 26 can be freely rotated, since the rack lever 39 has been pushed up by the projecting division 59 of the pin body 53. Therefore, it is possible to detach the cassette equipment from the dispensing equipment 30 when the knob 26 is further rotated about 45° in the leftward direction. Thus, the cassette equipment can be detached from the lock board 7 of the dispensing equipment 30 when the knob 26 is positioned in a horizontal level position (shown in FIG. 4). However, even when the cassette magazine 20 (shown in FIG. 4) is removed and the knob is then further rotated in the right direction, the knob can not be returned to its original condition. As shown in FIGS. 5*a* and 5*b*, the rack lever 39 will engage with the ratchet teeth even if it is intended to rotate the knob 26 in the leftward direction. As a result, the cassette equipment will be unable to be set into the lock board 7 of the card disposition equipment 30. In the condition of FIG. 4, when the knob 26 is rotated in the right direction, it must be rotated 90° (shown in FIG. 6). As shown in FIG. 6, even when the knob 36 is freely rotated and is further rotated in a leftward direction, the large diameter pin shaft 55 is fitted into the key hole 61. Therefore, the gate board member 21 will be securely locked by means of the key hole 61 in the pin shaft 55. Thus, the card exit opening 3 of the cassette magazine will not be opened even if the knob is rotated. The lid plate 16 must be opened in order to resist the stopper 62. The cassette magazine will have to be destroyed to gain access to the articles 36 stored therein.

As a result of this arrangement, it is possible to eliminate the theft problem that may occur when valuable articles are stored in the cassette magazine for mounting on appropriate dispensing equipment.

As can be seen for example in FIG. 5*a*, the lower portion of the gate board member 21 has ears, or projections 21*c*, that project downward. These corners, or projections 21*c*, are formed of a dimension to extend into small holes 13*h* in the base plate 13 (as seen in FIG. 2). The insertion of these projections 21*c* further reinforce the security to prevent cards or articles to be removed.

As a further modification, it is possible for a spring bias to be exerted against the array of cards or articles that are stored within the cassette magazine to ensure the dispensing or movement of the cards, even if the cassette equipment is mounted upside down or sideways.

As a result of the features of the present invention, additional security is provided in cassette magazines against operating personnel that have traditionally had access to the inventory of articles to be dispensed. As a result of the present invention, management personnel can ensure the proper charging of the articles to be dispensed before the cassettes are provided to service personnel. If the service personnel attempt to interfere or gain access to the articles, the security system of the present invention can prevent the unauthorized dispensing of articles from the cassette magazine.

Those skilled in the art will appreciate that various adaptations and modifications of the just-described preferred embodiments can be configured without departing from the scope and spirit of the invention. Therefore, it is to be understood that, within the scope of the appended claims, the invention may be practiced other than as specifically described herein.

What is claimed is:

1. A secure magazine for holding a plurality of articles to be dispensed comprising:

a housing member with a cavity for storing articles and having a lid that is openable to permit access to the cavity;

a lock member for locking the lid to the housing member;

a gate member movably mounted in the housing member from a closed position to an open position, said gate in said open position permitting an article to be moved by a dispensing mechanism from the magazine for dispensing thereof, said gate member, when said magazine is initially loaded with articles, disposed in the closed position, a one-cycle gate operating mechanism including a moveable actuator moveable from a first position to a second position to secure the magazine to the dispensing mechanism and coupled to the gate member for moving the gate member from the initial closed position to the open position for dispensing of articles by the dispensing mechanism and back to the first position to release the magazine from the dispensing mechanism and close the gate; and a gate locking assembly for locking the gate member in the closed position after one cycle of the actuator from the first position to the second position and back to the first position.

2. The device of claim 1 including a catch moveable to a latched position to couple said magazine to said dispensing mechanism in response to movement of said actuator from the first to the second position, said gate operating mechanism after said cycle locking said catch against movement to said latched position.

3. The device of claim 1 wherein said actuator is rotatable and coupled to a catch, rotation of said actuator from the first to the second position rotating the catch to secure the magazine to the dispensing mechanism and moving the gate to the open position, rotation of the actuator from the second back to the first position disengaging the catch and closing the gate.

4. The device of claim 3 wherein the one cycle locking mechanism includes a cam and follower disposed between said gate and said actuator to displace the gate between the first to the open second position in response to rotation of the actuator, and a ratchet surface on said cam and a pawl urged to engage said ratchet surface and permit rotation thereof only in the direction from said first position to said second position and a release adapted to disengage the pawl from the ratchet surface when said actuator is at said second position.

5. The device of claim 4 wherein said gate locking assembly and said release includes a pin moveable from a first to a second position to lock said gate when said gate is returned from said second position back to said first position.

6. The device of claim 5 wherein said gate includes a bore to receive said pin to lock said gate in the closed position.

7. In a dispensing apparatus for dispensing a plurality of articles having a mounting surface with a keeper, the improvement comprising:

a housing member with a cavity for storing articles and having a lid that is openable to permit access to the cavity;

a lock member for locking the lid to the housing member;

a gate member movably mounted in the housing member from a closed position to an open position, said gate in said open position permitting an article to be moved by a dispensing mechanism from the housing member for dispensing thereof, said gate member, when said housing member is initially loaded with articles, disposed in the closed position, a one-cycle gate operating mechanism including a moveable actuator moveable from a first position to a second position to secure the housing member to the dispensing mechanism and coupled to the gate member for moving the gate member from the initial closed position to the open position for dispensing of articles by the dispensing mechanism and back to the first position to release the housing member from the dispensing mechanism and close the gate; and a gate locking assembly for locking the gate member in the closed position after one cycle of the actuator from the first position to the second position and back to the first position.

8. The device of claim 7 including a catch moveable to a latched position to couple said housing member to said keeper on such dispensing mechanism in response to movement of said actuator from the first to the second position, said gate operating mechanism after said cycle locking said catch against movement to said latched position.

9. The device of claim 7 wherein said actuator is rotatable and coupled to a catch, rotation of said actuator from the first to the second position rotating the catch to secure the housing member to the dispensing mechanism and moving the gate to the open position, rotation of the actuator from the second back to the first position disengaging the catch and closing the gate.

10. The device of claim 9 wherein the one cycle locking mechanism includes a cam and follower disposed between said gate and said actuator to displace the gate between the first to the open second position in response to rotation of the actuator, and a ratchet surface on said cam and a pawl urged to engage said ratchet surface and permit rotation thereof only in the direction from said first position to said second position and a release adapted to disengage the pawl from the ratchet surface when said actuator is at said second position.

11. The device of claim 10 wherein said gate locking assembly and said release includes a pin moveable from a first to a second position to lock said gate when said gate is returned from said second position back to said first position.

12. The device of claim 11 wherein said gate includes a bore to receive said pin to lock said gate in the closed position.

* * * * *